US006184480B1

(12) United States Patent
Nishimoto et al.

(10) Patent No.: US 6,184,480 B1
(45) **Date of Patent: *Feb. 6, 2001**

(54) REVOLVING OPERATION ELECTRONIC COMPONENT AND ELECTRONIC APPLIANCE USING THE SAME

(75) Inventors: Takumi Nishimoto; Tetsuya Fukuda; Kenji Kataoka; Jun Sato, all of Tsuyama (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/362,752

(22) Filed: Jul. 29, 1999

(30) Foreign Application Priority Data

Jul. 30, 1998 (JP) ..... 10-215220

(51) Int. Cl.[7] ..... H01H 9/00
(52) U.S. Cl. ..... 200/4; 200/345
(58) Field of Search ..... 200/4, 5 A, 341–345

(56) References Cited

U.S. PATENT DOCUMENTS

| | | | | |
|---|---|---|---|---|
| 3,190,085 | | 6/1965 | Fillweber . | |
| 3,916,863 | * | 11/1975 | Hohne et al. | 123/148 R |
| 4,439,654 | * | 3/1984 | Bresin et al. | 100/302.1 |
| 5,555,004 | | 9/1996 | Ono et al. . | |
| 5,568,356 | * | 10/1996 | Schwartz | 361/679 |
| 5,606,155 | | 2/1997 | Garcia . | |
| 5,668,358 | * | 9/1997 | Wolf et al. | 200/5 A |
| 5,889,242 | | 3/1999 | Ishihara et al. . | |
| 5,952,628 | * | 9/1999 | Sato et al. | 200/4 |

FOREIGN PATENT DOCUMENTS

| | | |
|---|---|---|
| 1 011 960 | 7/1957 | (DE) . |
| 0 717 424 | 6/1996 | (EP) . |

* cited by examiner

*Primary Examiner*—Michael L. Gellner
*Assistant Examiner*—Nhung Nguyen
(74) *Attorney, Agent, or Firm*—McDermott, Will & Emery

(57) ABSTRACT

Operating rod 21 is provided with a spherical portion 21B that has a polygon shape in the horizontal cross section, which is engaged with a polygonal opening 23C provided above a central opening 23A of a revolving member 23 so that the two items make a same revolution together, yet the operating rod 21 can make a free up-down movement independently. The operating rod 21 has a pushing portion 21D at the lower end; upper surface of which pushing portion 21D is keeping an elastic contact to a middle ring-platform 23B of the revolving member 23 via a washer 4. So, even when the operating rod 21 is positioned slightly aslant, it can perform both revolving and up-down actions smoothly. In an electronic appliance incorporating the revolving operation electronic component of the above structure, the clearance margin to be provided in relation to an operating knob and an aperture for the knob can be made small. Thus the electronic component in accordance with the present invention contributes to offer electronic appliances of high quality-grade with which a smooth feeling of operation is assured.

10 Claims, 6 Drawing Sheets

REVOLVING OPERATION ELECTRONIC COMPONENT AND ELECTRONIC APPLIANCE USING THE SAME

FIELD OF THE INVENTION

The present invention relates to an electronic component that can be operated by revolving the operating portion standing out of front panel of an appliance, and an electronic appliance incorporating the component.

BACKGROUND OF THE INVENTION

In the prevailing trends in the electronic industry for downsizing appliances, a point of issue is in the relative dimensional accuracy of assembly within an appliance incorporating the components.

For example, in a case where operating portion of a component is standing out from appliance body incorporating the component, it is important to make gap between the operating portion and an aperture of front panel as small as possible from the view point of preciseness of an assembly. On the other hand, however, the gap also plays an important role in absorbing relative dislocation between the panel aperture and the electronic component mounted in the appliance. Therefore, there is a limitation in making the gap small.

A conventional technology is described below using a rotary encoder as an example of the above revolving operation electronic component.

FIG. 5 shows a cross sectional front view of a conventional rotary encoder having push-switch function. The upper part of an operating rod 1 is standing out as an operating section 1A, and a middle column 1B is supported by a round hole 2A of a bearing 2 so that it can make revolving and up-down movements. The operating rod 1 is engaged at a non-round column portion 1C, which is locating lower to the middle column 1B, with a non-round center opening 3A of a revolving member 3 so that the two items revolve together, while the operating rod 1 is allowed to make a free up-down motion independently. A washer 4 is provided at the bottom of the non-round column portion 1C for preventing withdrawal of the operating rod 1.

On the bottom surface of lower flat portion 3B of revolving member 3, a contact board 5 is provided, on which contact board 5 a plurality of line-shaped contact points are disposed in a radial arrangement extending from the center to outside. There are three slider contacts 7A, 7B and 7C popping up from a substrate 6 for keeping an elastic contact with the contact board 5. First terminals 7D, 7E and 7F, connected to respective contact points of the contact board 5, are provided at the outside of bottom part.

There are fixed contact points 8A and 8B in the center of the substrate 6, which fixed contact points are connected to second terminals 8C and 8D provided at the outside of bottom part. Provided above the fixed contact points 8A, 8B is a movable contact plate 9 of domed shape made of a thin metal plate. On the movable contact plate 9, a drive member 10 is provided to form a push-switch. Pushing portion 1D of the operating rod 1 keeps contact with the upper surface of the drive member 10.

The bearing 2 and the substrate 6 are coupled together with a metal frame 11. A mounting foot 11A is provided at the bottom of the metal frame 11 to facilitate its mounting on a circuit board.

In a rotary encoder with push-switch having the above structure, a revolving action given to the operating section

1A of operating rod 1 brings the revolving member 3 to revolve, and the slider contacts 7A, 7B, 7C slide over the surface of contact board 5, which is disposed on the bottom surface of the flat portion 3B. The encoder signals are thus generated.

By a press-down action given on the operating rod 1, the domed movable contact plate 9 contacting to the drive member 10 is reversed to provide electrical contact between the fixed contact points 8A and 8B. Thus, it functions as a push-switch.

FIG. 6 is a cross sectional front view showing the relative relationship between front panel of an appliance and operating knob of a rotary encoder mounted therein. The rotary encoder is mounted on a circuit board 14 of an appliance by inserting the mounting foot 11A, the first terminals 7D, 7E, 7F and the second terminals 8C, 8D coming from substrate 6 into corresponding holes of circuit board to be soldered. An operating knob 12 of column shape is put on the operating section 1A of operating rod 1, and then the circuit board 14 is installed in the appliance so that the operating knob 12 stands out through an aperture 13A of front panel 13.

In the general cases, conventional rotary encoders (the revolving operation electronic components) are first mounted and fixed with solder on a circuit board 14 of appliance, and then the circuit board 14 is installed to a specified place within the appliance. In this case, it is not easy to align the operating knob 12 put on operating rod 1 to the precise location of aperture 13A of front panel 13.

If there is a substantial relative dislocation between the operating knob 12 and the aperture 13A, the operating knob 12 may make contact with the edge of aperture 13A to a blocked functioning, and a comfortable feeling of operation is injured. In order to avoid this to happen, designers of the appliance are compelled to provide a relatively large clearance between the operating knob 12 and the edge of aperture 13A. For compact-size appliances such a large aperture gap is not only conspicuous in the appearance, but it also deteriorates the quality level in the appraisal of products.

The present invention aims to improve the above drawbacks and offer a revolving operation electronic component, as well as an appliance incorporating the component; with which the gap between operating knob and aperture edge can be reduced to a minimum without inviting an inconvenience that results from the relative dislocation between operating knob and front panel aperture.

SUMMARY OF THE INVENTION

A revolving operation electronic component of the present invention comprises a bearing having round hole in the center, a revolving member having in the cylindrical portion a polygonal opening for a section upper than a middle ring-platform, which ring-platform being perpendicular to central axis of the round hole of bearing, and a central opening, whose diameter is greater than that of the polygonal opening, for a section lower than the middle ring-platform, which revolving member being supported at the cylindrical portion by the round hole of the bearing in a freely revolving manner and attached with a contact board on a flat bottom area locating at a level lower than the middle ring-platform, a substrate which contains slider contacts that keep elastic contact with the contact board and is disposed encountering the revolving member, an operating rod having a spherical portion, whose horizontal cross section is a polygon, being engaged with the polygonal opening of the revolving member so that the two items revolve together while the rod is free to make up-down motion independently, which rod further having an operating section above the polygon-spherical portion and a pushing portion at the bottom of the polygon-spherical portion, and a movable contact plate which provides upward pressure to the pushing portion of operating rod so that the upper surface of pushing portion keeps an elastic contact against the middle ring-platform of the revolving member. As the operating rod is engaged at the polygon-spherical portion with the revolving member in the polygonal opening for making the same revolution together, revolving operation can be performed smoothly even if the operating rod is positioned aslant for a certain degree. As the operating rod is always provided with an upward pressure by the spring-back movable contact plate of domed shape, the upper surface of pushing portion of the operating rod is kept pressed to the middle ring-platform of revolving member; so, the operating rod keeps taking an upright position, or the neutral position, unless it is given with a tilting force.

DESCRIPTION OF PREFERRED EMBODIMENTS

Figure 1:
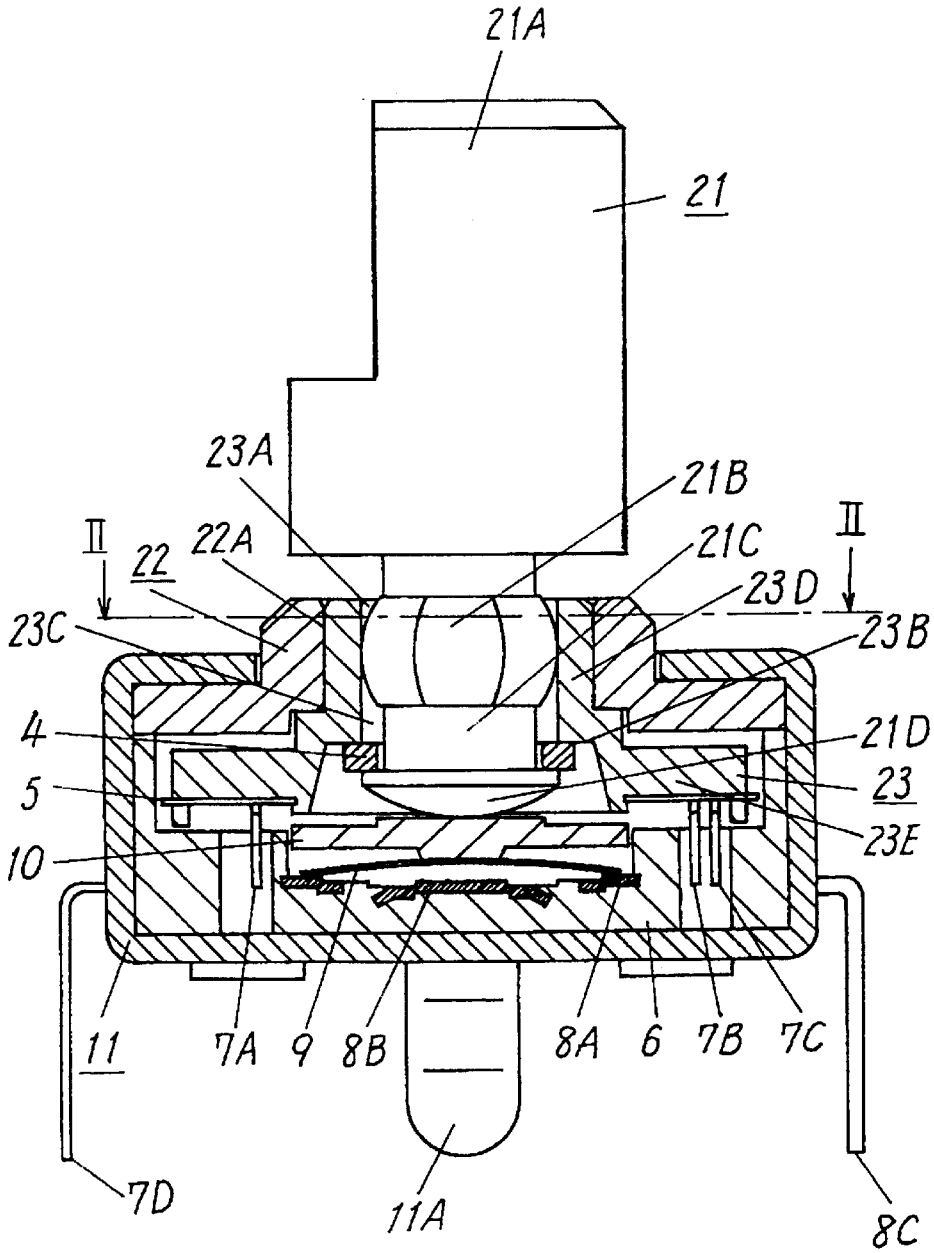
FIG. 1 shows a cross sectional front view of a rotary encoder in accordance with an exemplary embodiment of the present invention.

Revolving operation electronic component in accordance with an exemplary embodiment of the present invention is described referring to the drawings, using a rotary encoder as the practical example.

Providing the same symbols represents those portions of the electronic component having the same structure as those already described with respect to the conventional technology, and detailed descriptions of which are omitted.

Figure 2:
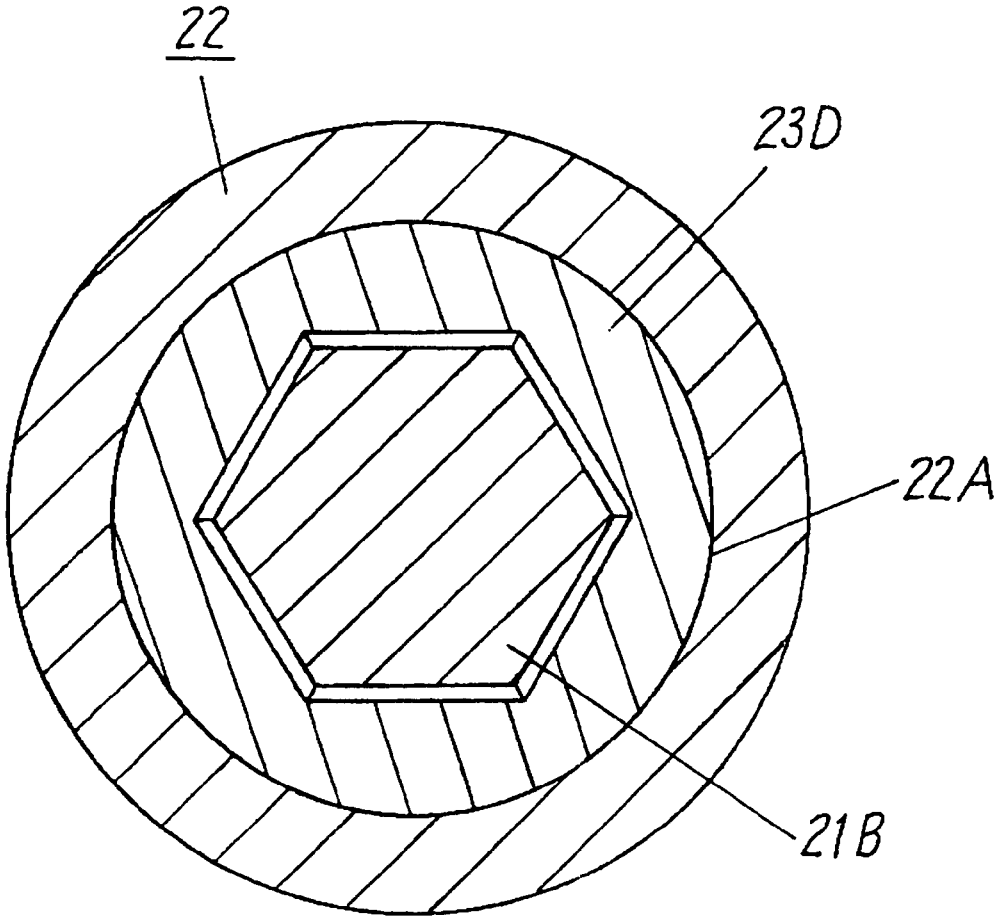
FIG. 2 is a cross sectional view of the rotary encoder, sectioned at line II—II of FIG. 1.

FIG. 1 shows a cross sectional front view of a rotary encoder having push-switch function, in accordance with an exemplary embodiment of the present invention. FIG. 2 is a cross sectional view of the rotary encoder sectioned at line II—II of FIG. 1. As shown in FIG. 1, a metal operating rod 21 has at the upper end an operating section 21A of table shape, and beneath it a polygon-spherical portion 21B (whose horizontal cross section is a polygon), which being engaged with a polygonal opening 23C disposed in the upper portion of central opening 23A in a revolving member 23.

The revolving member 23, which is supported at the cylindrical portion 23D by a round hole 22A of bearing 22 for making a free revolving action, is engaged with the operating rod 21 so that the two items make the same revolving movement together.

The operating rod 21 has a round column portion 21C beneath the polygon-spherical portion 21B, the diameter of round column portion 21C being smaller than that of polygon-spherical portion 21B. Beneath the round column portion 21C, a pushing portion 21D is provided, whose diameter being greater than that of the round column portion 21C and smaller than that of a circle inscribed in the polygonal opening 23C of revolving member 23. A ring washer 4 is provided interposed between the upper surface of the pushing portion 21D and a middle ring-platform 23B of revolving member 23.

The polygon-spherical portion 21B has a polygon form in the horizontal cross sectional view composed of six planes disposed to encounter the radial direction, as shown in FIG. 2. Each of the six planes is curved in the axial direction to a certain specific curvature; which may be understood from the cross sectional illustration in FIG. 1.

The washer 4 makes contact at the upper surface with the middle ring-platform 23B of revolving member 23 so that the operating rod 21 does not go further upward, while a downward movement is allowed.

A contact board 5 which is provided on the surface of a flat bottom area 23E of the revolving member 23 is receiving an elastic contact from slider contacts 7A, 7B, 7C protruding from a substrate 6. At the center of the substrate 6, fixed contact points 8A, 8B are provided.

Over the fixed contact points 8A, 8B, an elastic movable contact plate 9 of domed shape and a drive member 10 are provided to form a push-switch. A pushing portion 21D of operating rod 21 is making contact with the upper surface of the drive member 10. The bottom of pushing portion 21D of operating rod 21 has a domed shape, which shape sharing a substantially same center point with the polygon-spherical portion 21B.

The operating rod 21 is always pressed upward by the movable contact plate 9 of domed shape via the drive member 10; as a result, the upper surface of washer 4 disposed at the round column portion 21C locating in the lower part of operating rod 21 makes an elastic contact to the middle ring-platform 23B of revolving member 23. Thus, the operating rod 21 is kept in an upright state, or a neutral position.

A mounting foot 11A is provided at the bottom of metal frame 11, which couples the bearing 22 and the substrate 6, to facilitate mounting of the component on a circuit board of electronic appliance.

In a rotary encoder with push-switch having the above described structure, a revolving action given to the operating rod 21 revolves the revolving member 23 engaged with the operating rod 21 for making the same revolving motion together, and the slider contacts 7A, 7B, 7C slide over the contact board 5 disposed on the revolving member 23. Encoder outputs are thus generated. By pushing the operating rod 21 down, the domed movable contact plate 9 is pressed down by the drive member 10 disposed keeping contact with the pushing portion 21D of operating rod 21. This results in a switch-ON state between the fixed contact points 8A and 8B disposed on the substrate 6. As soon as the pushing force given on the operating rod 21 is removed, the movable contact plate 9 restores the initial domed shape, a switch-OFF state is formed, and the operating rod 21 returns to the initial position before the pushing force was given thereon.

Figure 3:
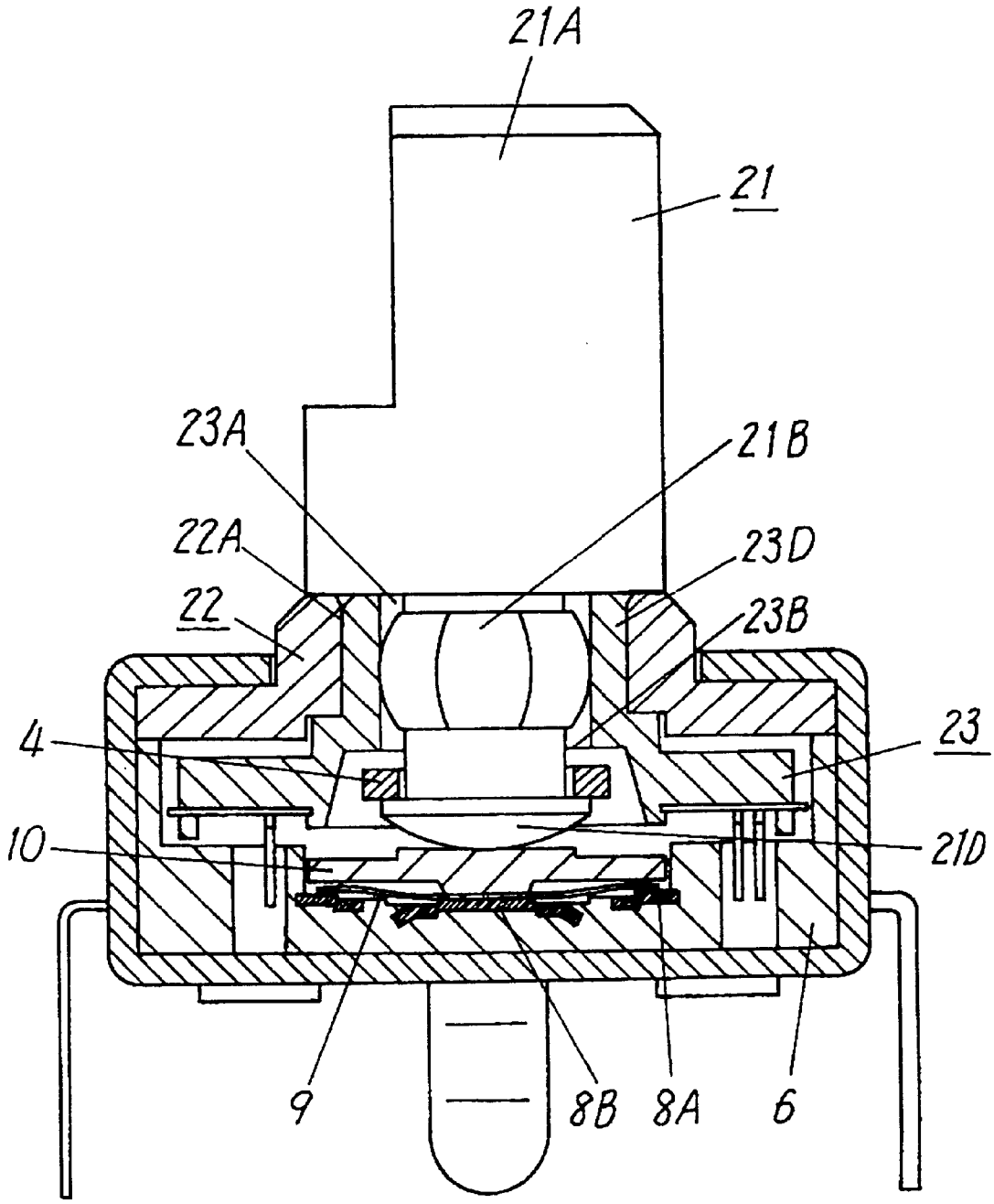
FIG. 3 is a cross sectional front view of the rotary encoder, showing a state when the operating rod is pushed down.

By making the diameter of the operating section 21A of operating rod 21 greater than that of round hole 22A of bearing 22, as shown in FIG. 3, push-in stroke of the operating rod 21 is limited, and the push-switch is protected from having too much pressure.

Figure 4:
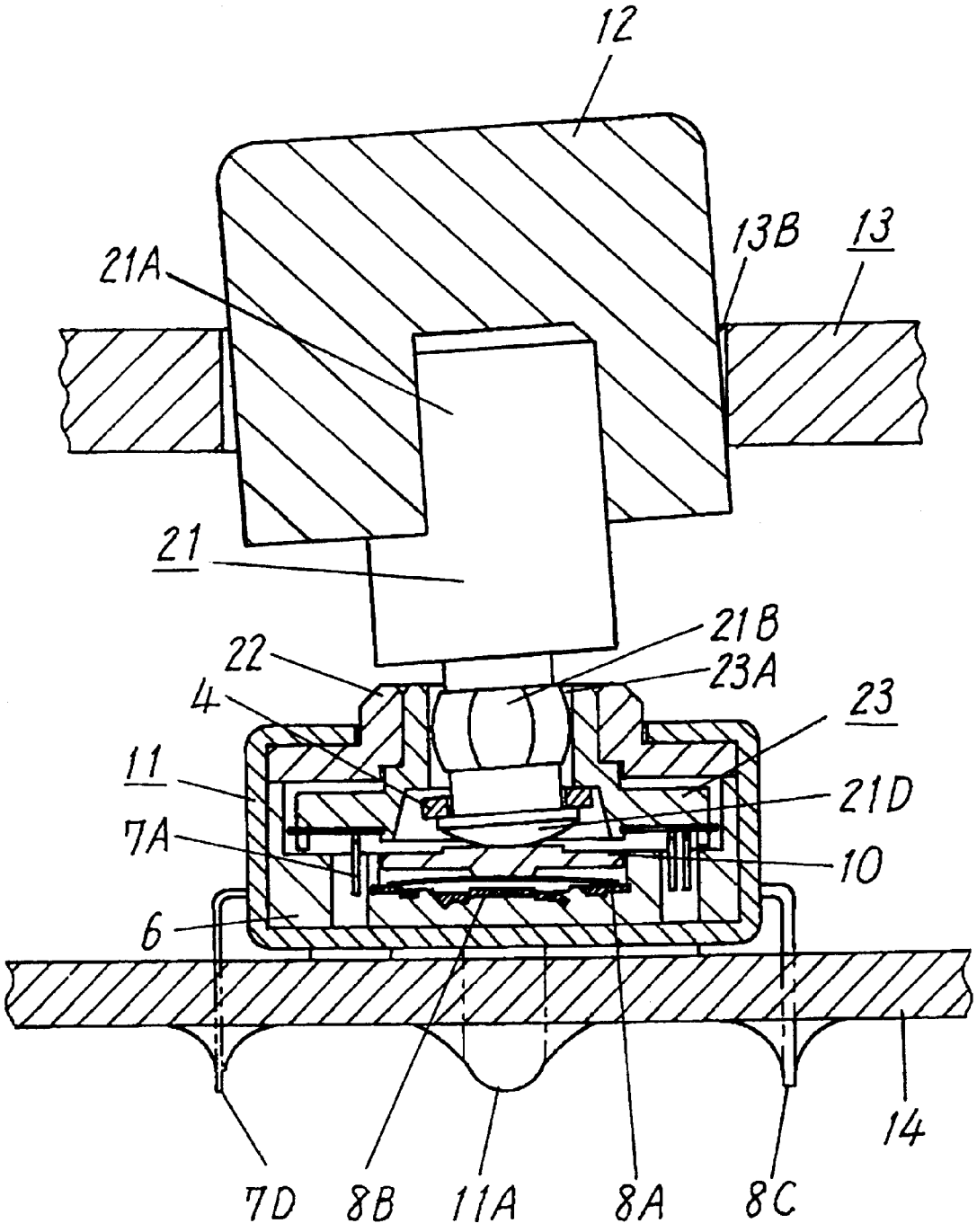
FIG. 4 is a cross sectional front view showing a part of electronic appliance incorporating the rotary encoder.
Figure 5:
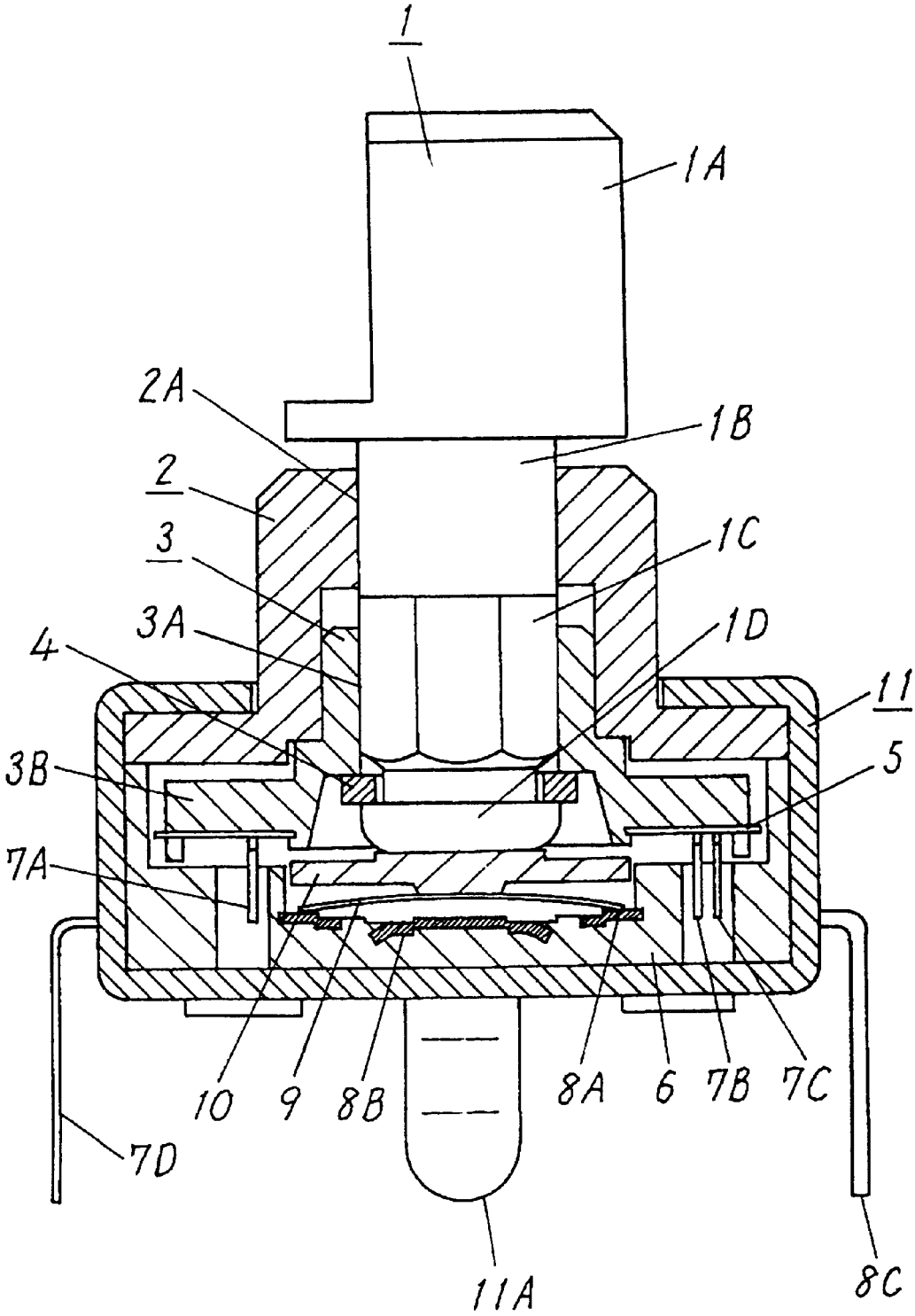
FIG. 5 PRIOR ART
FIG. 5 is a cross sectional front view of a conventional rotary encoder.
Figure 6:
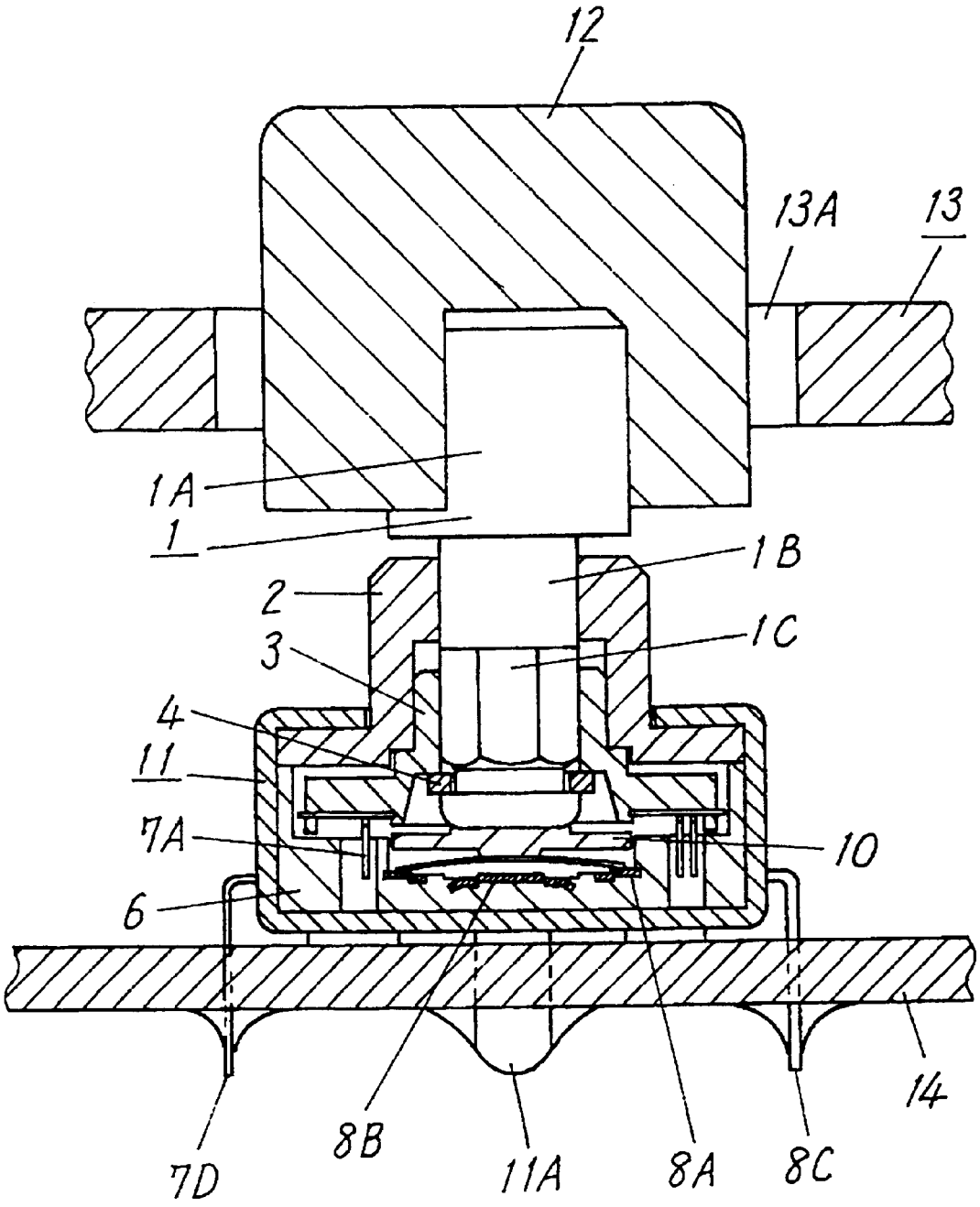
FIG. 6 PRIOR ART
FIG. 6 is a cross sectional front view showing a part of electronic appliance incorporating the conventional rotary encoder.

In a case when a tilting force is given on the operating rod 21 as shown in FIG. 4, the operating rod 21 tilts accordingly without having a difficulty, with the center point of the polygon-spherical portion 21B as the center of the movement.

Even if the operating rod 21 is in a tilted position, the state of engagement of the polygon-spherical portion 21B in terms of horizontal direction with the polygonal opening 23C of revolving member 23 remains unchanged. Therefore, the revolving member 23 can smoothly accompany the operating rod 21 to make a revolving motion together.

As the pushing portion 21D of operating rod 21 has a domed shape, which shares a substantially same center point with the polygon-spherical portion 21B, and the upper surface of drive member 10 making contact with the convex surface of pushing portion 21D is flat, the point of making contact with pushing portion 21D always locates at the center of drive member 10. This means that the operating rod 21 works smoothly regardless of whether it is tilting or not, and the push-switch is ready to function smoothly at any stance.

Although in the present embodiment a washer 4 is provided interposed between the pushing portion 21D of operating rod 21 and the revolving member 23 for preventing the operating rod 21 from withdrawal, it can be eliminated by making the diameter of pushing portion 21D greater than that of the polygon-spherical portion 21B.

Although in the present embodiment a drive member 10 is provided interposed between the pushing portion 21D of operating rod 21 and the domed movable contact plate 9, it can be eliminated by arranging the pushing portion 21D to push direct on the domed movable contact plate 9.

As described in the above, a rotary encoder (the revolving operation electronic component) in accordance with the present invention provides a smooth operation in terms of both revolving and pressing movements even when the operating rod is positioned slightly aslant. In the following, an electronic appliance incorporating the rotary encoder is described with reference to FIG. 4.

The rotary encoder is incorporated in an electronic appliance by first mounting it on a circuit board 14 of the electronic appliance soldering the first terminals 7D and 7E, 7F (not shown), the second terminals 8C and 8D (not shown) and the mounting foot 11A of metal frame 11 thereon, attaching an operating knob 12 of round column shape on the operating rod 21, and then installing the circuit board 14 in the electronic appliance so that the operating knob 12 stands out of the aperture 13B of front panel 13.

The aperture 13B of front panel 13 has a diameter that is slightly greater than the outer diameter of operating knob 12. As a result, in some cases, the operating knob 12 of the electronic component installed in the electronic appliance might have contact with the edge of aperture 13B, making the operating rod 21 slightly tilted. Even in such cases, the operating rod 21 tilts accordingly without much difficulty, and the operating rod 21 under such a state functions smoothly to perform both revolving and pressing operations. Thus, the diameter of aperture 13B of the front panel 13 can be made small to reduce a gap to be formed with the operating knob 12, and a compact electronic appliance may be presented at a high quality-grade.

A revolving operation electronic component in accordance with the present invention offers a smooth operation even when the operating rod is slightly tilted. When the revolving operation electronic component is used in an electronic appliance, there will be a reduced gap in the electronic appliance between the operating knob and the aperture of front panel for the knob, and a comfortable feeling of operation is not sacrificed. Thus compact electronic appliances may be presented at a high quality-grade.

What is claimed is:

1. A revolving operation electronic component comprising:

a bearing having a round hole in the center;

a revolving member having in the cylindrical portion a polygonal opening for a section upper than a middle ring-platform, which ring-platform being perpendicular to central axis of the round hole of the bearing, and a central opening, whose diameter is greater than that of said polygonal opening, for a section lower than the middle ring-platform, said revolving member being supported at the cylindrical portion by said round hole of said bearing in a freely revolving manner and attached on the flat bottom area locating at a level lower than the middle ring-platform with a contact board;

a substrate, which holds slider contacts that keep elastic contact to said contact board, provided to encounter said revolving member;

an operating rod comprising a polygonal portion having a polygonal horizontal cross section and curved surfaces along an axial direction of the operating rod, which curved surfaces being engaged with said polygonal opening of the revolving member for making the same revolution together with said revolving member while it is free to move up and down independently, a pushing portion located below said curved surfaces, and an operating section located above said curved surfaces; and a movable contact plate of domed shape which provides upward pressure to said pushing portion so that the upper surface of said pushing portion keeps an elastic contact against the middle ring-platform of the revolving member.

2. The revolving operation electronic component of claim 1, wherein a pressing-down of said operating rod brings said movable contact plate of domed shape to form electrical connection between fixed contact points.

3. The revolving operation electronic component of claim 1 or claim 2, wherein said pushing portion has a domed shape which shares a substantially same center point with said polygonal portion having polygon cross section, and the upper surface of said drive member making contact with the domed shape is flat.

4. An electronic appliance incorporating a revolving operation electronic component, an operating knob and a front panel, said revolving operation electronic component comprising:

a bearing having a round hole in the center;

a revolving member having in the cylindrical portion a polygonal opening for a section upper than a middle ring-platform, which ring-platform being perpendicular to central axis of said round hole of the bearing, and a central opening, whose diameter is greater than that of said polygonal opening, for a section lower than the middle ring-platform, said revolving member being supported at the cylindrical portion by said round hole of said bearing in a freely revolving manner and attached on the flat bottom area locating at a level lower than the middle ring-platform with a contact board;

a substrate, which holds slider contacts that keep elastic contact with the contact board, provided to encounter said revolving member;

an operating rod comprising a polygonal portion having a polygonal horizontal cross-section and curved surfaces along an axial direction of the operating rod, which curved surfaces being engaged with said polygonal opening of the revolving member for making the same revolution together with said revolving member while it is free to move up and down independently, a pushing portion located below said curved surfaces, and an operating section located above said curved surfaces; and a movable contact plate of domed shape which provides upward pressure to said pushing portion so that the upper surface of said pushing portion keeps an elastic contact against the middle ring-platform of the revolving member; wherein said operating knob is attached on said operating rod of said revolving operation electronic component, and said operating rod is supported so that it can make a free revolving movement in an aperture of said front panel provided only with a small clearance margin.

5. The electronic appliance of claim 4, wherein a pressing-down of said operating rod brings said movable contact plate of domed shape to form electrical connection between fixed contact points.

6. The electronic appliance of claim 4 or claim 5, wherein said pushing portion has a domed shape which shares a substantially same center point with said polygonal portion having polygon cross section, and the upper surface of said drive member making contact to the domed shape is flat.

7. The revolving operation electronic component of claim 1, wherein said pushing portion includes a dome-shaped lower end.

8. The electronic appliance of claim 4, wherein said pushing portion includes a dome-shaped lower end.

9. A revolving operation electronic component comprising:

a bearing having a hole extending therethrough;

a revolving member fitted at least partially within said hole, said revolving member including a first end, a middle ring-platform and a contact board, said revolving member further including a hole extending therethrough defining an inner polygonal surface between said first end and said middle ring-platform, said revolving member being configured to be freely rotatable;

a substrate holding contacts that elastically engage said contact board, provided to encounter said revolving member;

an operating rod including a polygonal portion and a pushing portion, said polygonal portion having a polygonal horizontal cross section and curved surfaces along an axial direction of the operating rod, said polygonal portion being engaged with said inner polygonal surface of the revolving member for making the same revolution together with said revolving member while it is free to move up and down independently; and a movable contact plate for providing upward bias pressure to said pushing portion.

10. The revolving operation electronic component of claim 9, wherein said pushing portion has a dome-shaped bottom surface.

* * * * *